US009396671B2

(12) United States Patent
Gryczynski et al.

(10) Patent No.: US 9,396,671 B2
(45) Date of Patent: Jul. 19, 2016

(54) ENHANCED TAMPER EVIDENT SEAL

(71) Applicants: Janusz Gryczynski, Bangor, PA (US); Robert Debrody, Wayne, NJ (US)

(72) Inventors: Janusz Gryczynski, Bangor, PA (US); Robert Debrody, Wayne, NJ (US)

(73) Assignee: E.J. Brooks Company, Farmington Hills, MI (US)

( * ) Notice: Subject to any disclaimer, the term of this patent is extended or adjusted under 35 U.S.C. 154(b) by 249 days.

(21) Appl. No.: 13/839,071

(22) Filed: Mar. 15, 2013

(65) Prior Publication Data

US 2014/0265368 A1 Sep. 18, 2014

(51) Int. Cl.

| | |
|---|---|
| ***B65D 33/34*** | (2006.01) |
| ***G09F 3/03*** | (2006.01) |
| *B65D 27/30* | (2006.01) |

(52) U.S. Cl.

CPC ..... *G09F 3/0347* (2013.01); *G09F 3/0358* (2013.01); *G09F 3/0376* (2013.01); *Y10T 29/49826* (2015.01); *Y10T 292/498* (2015.04)

(58) Field of Classification Search

CPC ..... G09F 3/0358; G09F 3/0382; B65D 33/34; E05B 67/383

USPC ..... 292/320, 315–321, 307 B, 329

See application file for complete search history.

(56) References Cited

U.S. PATENT DOCUMENTS

| | | | | | |
|---|---|---|---|---|---|
| 998,878 | A * | 7/1911 | Dinsmoor | 292/320 |
| 2,006,042 | A * | 6/1935 | Dietze | 292/328 |
| 2,020,198 | A * | 11/1935 | Miller | 292/328 |
| 3,980,332 | A * | 9/1976 | King, Sr. | 292/320 |
| 4,887,855 | A * | 12/1989 | Tritton et al. | 292/307 R |
| 4,909,552 | A * | 3/1990 | Weber et al. | 292/320 |
| 5,427,423 | A * | 6/1995 | Georgopoulos | 292/320 |
| 8,485,572 | B2 * | 7/2013 | Nazzari | 292/315 |
| 2007/0057788 | A1 * | 3/2007 | Wu | 340/572.1 |
| 2011/0148127 | A1 * | 6/2011 | Nazzari | G09F 3/0358 292/315 |
| 2011/0210567 | A1 * | 9/2011 | Nazzari | 292/315 |
| 2014/0265369 | A1 * | 9/2014 | Gryczynski | 292/320 |

* cited by examiner

*Primary Examiner* — Mark Williams

(74) *Attorney, Agent, or Firm* — Bejin Bieneman PLC

(57) ABSTRACT

A tamper evident seal includes a wire hasp, an insert and a body for receiving the insert and the wire hasp. The one leg of the wire hasp must be located in the channel in the insert prior to the insert being located in the body. A coupling structure for coupling the insert in the body includes angularly extending supports extending angularly outwardly upwardly from the sides of the insert for engaging indentations in the sides of the body for further preventing removal of the insert and the wire hasp once they are fully inserted in the body and in the insert, respectively. The insert of the seal further includes centrally located reinforcing extension members, each including a round base portion partially extending above base surface of the insert and a centrally located, flattened side tamper evident extension member extending from the round base portion and which extension member which will show a blemish if the insert is tampered after the seal is completed.

9 Claims, 4 Drawing Sheets

210
12
14
16
18
20
22
24
30
32
41
43
44
45
46
56
58
64
67
70
82
85
86
151
153
174
175
176
177
195

ENHANCED TAMPER EVIDENT SEAL

BACKGROUND

It is generally known to provide a tamper evident seal such as a molded plastic security seal of a padlock-type. Padlock-type security seals used as a means for sealing all types of housings including electric meters and the like.

Security seals of the padlock type are generally known and are in wide spread use for sealing currency bags, closures, and electric meters and so on. Examples of such seals are shown in the following U.S. Pat. Nos. 3,485,461; 3,373,033; 3,980,332; 4,353,583; 4,278,281; 4,687,240; 4,832,387; 4,893,853; 4,775,175; 5,314,429; and 5,427,423. Such tamper evident seals generally have a plastic body with a pair of passages defined by a body and insert and opening to one end of the body and a shackle or wire hasp formed of a piece of generally U-shaped wire having a pair of legs with bent end portions for being secured within a respective aperture of the plastic body. In the locked position, the legs are bent and permanently received in a pocket in each passage of the plastic body such that if the legs are forcibly removed, it is evident from visual inspection that the security seal is broken or tampered. In the open position, the wire hasp or shackle is completely separate from the body and insert and the legs are not inserted in the passages of the body and insert. In such generally known seals, the relative dimensions of the passages or chambers, the shackle, and the locking grooves are chosen to attempt to limit or prevent picking. However, the known devices have led to other issues and modes of failure such as the use of a corrosive liquid deposited in the passage or chamber to dissolve the metal shackle or wire hasp, or at least one of the legs, such that the seal may be compromised and then put back and appear to still be secure. Such tampering is done also because it appears that seal has merely failed due to environmental factors and not due to intentional tampering. Despite such known devices, there long remains a significant unmet need for an improved tamper evident seal that better guards against non-forcible types of tampering.

DRAWINGS

Figure 1:
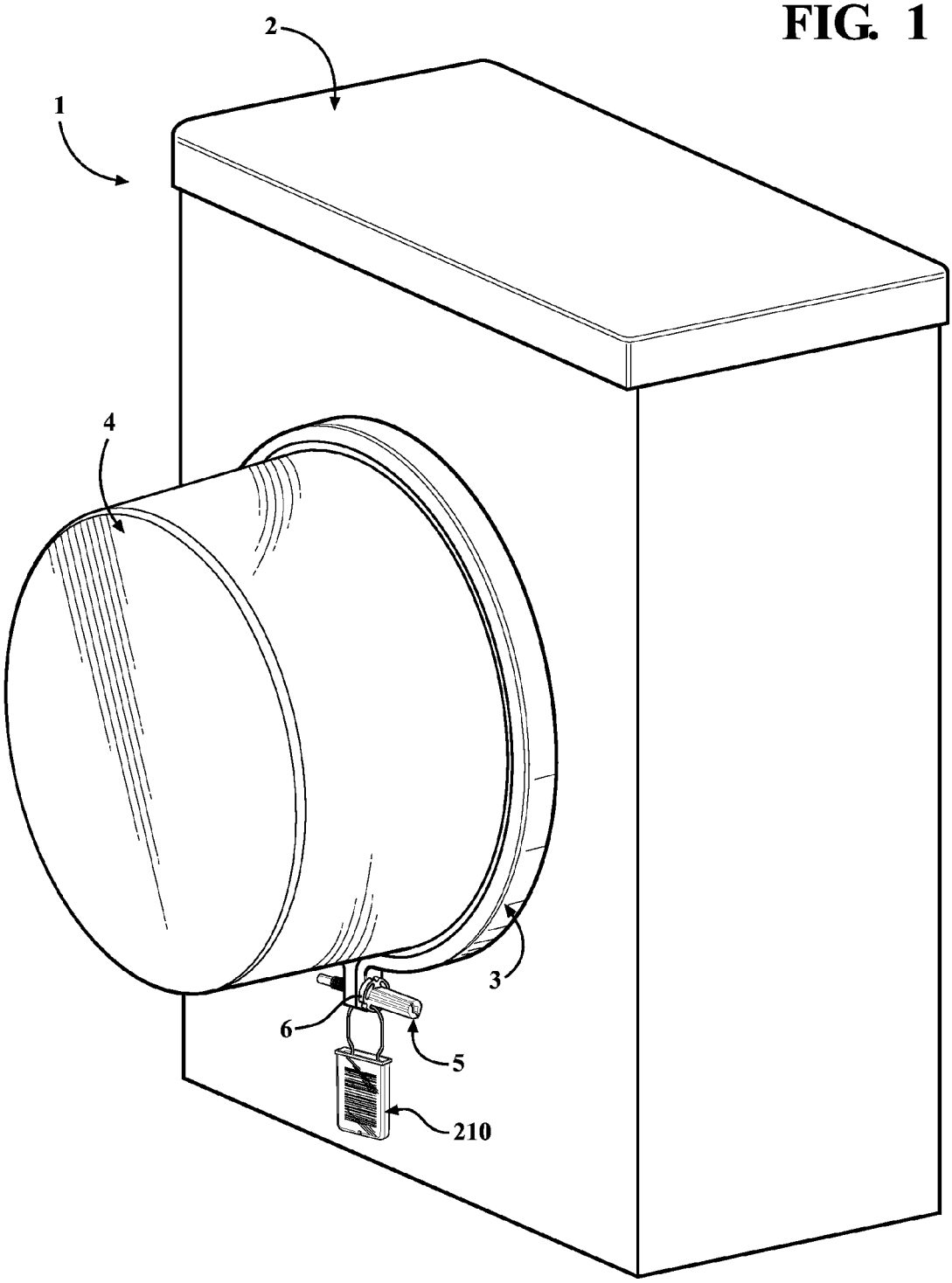
FIG. 1 is a perspective graphic view of an electric meter housing including a tamper evident seal according to an exemplary embodiment of the present disclosure.
Figures 4, 5, 6:
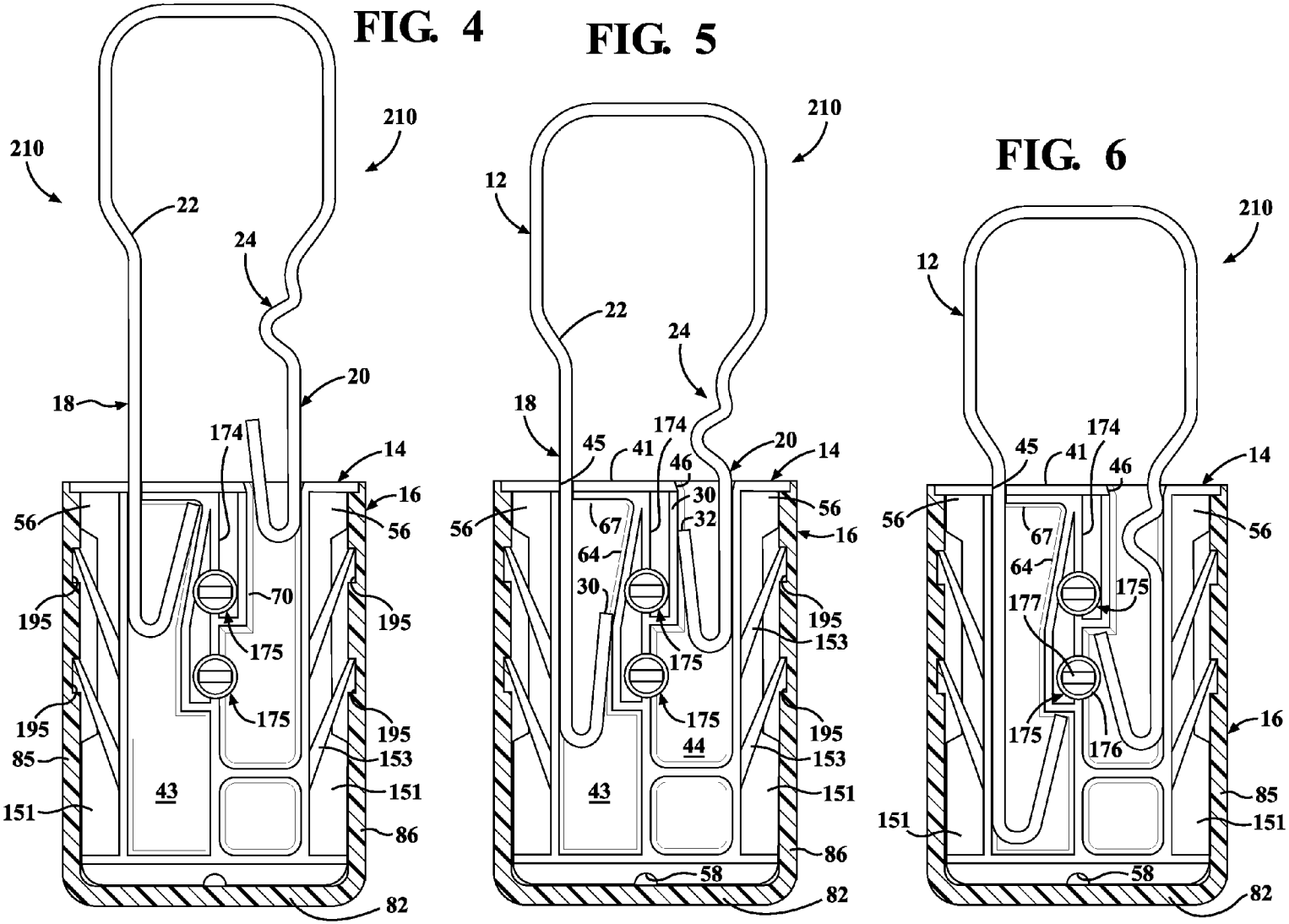
FIG. 4 is a partial, front plan graphic view of the temper evident seal according to the exemplary embodiment of FIG. 1 with the shackle or wire hasp in an first or unlocked position with the first leg of the wire hasp secured in the seal and the second leg of the wire hasp unsecured from the seal.

FIG. 5 is a partial, front plan graphic view of the temper evident seal according to the exemplary embodiment of FIG. 1 with the first and second legs of the shackle or wire hasp in a partially inserted position; and FIG. 6 is a partial, front plan graphic view of the temper evident seal according to the exemplary embodiment of FIG. 1 with the first and second legs of the shackle or wire hasp in a fully inserted or locked position in the seal.

DETAILED DESCRIPTION

Referring in general to all of the Figures and in particular to FIGS. 1 through 6, an exemplary embodiment of a tamper evident seal, such as a padlock type seal, according to the present disclosure and teachings is provided for use with any known or appropriate apparatus for which there is a desire for the ability to determine if the apparatus has been tampered or breached. Such tamper evident seals may generally be used to secure a utility meter 1 (e.g., electricity meter, gas meter, water meter and the like) such as those commonly associated with a home or office or other commercial building. The utility meter 1 includes a box or enclosure 2 which may be sealed using a rating three for securing a glass enclosure 4 to the box 2. The ring 3 has ends coupled together by a bolt 5 which may include a passage or hole 6 for securing the ring 3 to the box 2. A tamper evident seal 10 according to the present disclosure is coupled through the passage 6 of the bolt 5 and the ends of the ring 3 to provide a single point of securing the meter 1. Since the utility meter 1 may monitor the usage of a resource which a user normally pays for, it is not uncommon for an owner and/or thief to attempt to tamper with the utility meter to steal the resource without the utility meter registering the stolen resource. Typically, such utility meters are inspected on a semi regular basis during which the tamper evident seal is visually inspected to observe whether the integrity of the seal has been broken. Inspection requires the party responsible for the utility meter to pay the related costs of visual inspection. Accordingly, the more frequent the visual inspection, the greater the cost. The more infrequent the visual inspection, more likely someone is to attempt to breach the tamper evident seal.

Generally, the tamper evident seal 210 of the present disclosure includes a design similar to the design of the security seal 10 disclosed in U.S. Pat. No. 5,427,423, the entire contents of which is incorporated herein by reference for all purposes. The seal 210 may include a resilient shackle or wire hasp 12, a sealed body or enclosure 16 and an insert or inner member 14. The wire hasp 12 may be formed of a resilient spring wire having a generally U-shape form with a first or long leg 18 and a second or short leg 20. Each of the legs 18 and 20 may have reversely bent end portions 30 and 32, respectively, for securing the legs within seal 210 as best shown in FIG. 6. The wire hasp 12 is preferably formed using any known or appropriate manner from a round cross-section galvanized or stainless steel. In one particular exemplary embodiment, the wire hasp 12 has a generally constant thickness 23 of approximately about 1.32 mm (0.052"). Further, the thickness 23 of the wire hasp 12 may be approximately about 1.19 mm (0.05"). The wire hasp 12 of the exemplary embodiment may preferably be formed of a resilient spring wire. The leg 18 may include a narrowing bent portion 22 and the leg 20 may include a reversely bent portion 24 for limiting the ability of the leg 20 to be picked when it is received in the passage of the insert 14 in the body 16. The bent portion 22 is provided for enlarging and balancing the proportions of the bight portion of the u-shaped wire hasp 12 and, quite uniquely, does not include a reversely bent portion similar to that of the portion 24 of the leg 20.

The insert 14 may preferably be made from a plastic material or any other known or appropriate material. The insert 14 may further include a first or top end 41 and a second or bottom end 42. The insert 14 further may include a first channel 43 (which may also be referred to as a first passage or a first chamber) and a second channel 44 (which may also be referred to as a second passage or a second chamber), each of which extend generally between the top end 41 and the bottom end 42 and are arranged side-by-side. The first channel 43 may be accessed through a first opening 45 (which may also be referred to as a first passage) in the top end 41 of the insert 14. Similarly, the second channel 44 may be accessed through a second opening 46 (which may also be referred to as a second passage) in the top end 41 of the insert 14. The first channel 43 may be further defined on one side by a central rib or extension member 47 which generally extends from the end 42 to a mid-point of the insert 14 to the wall 62 on the other side by the first side or wall 48 which extends from the first end 41 to the second end 42. Similarly, the second channel 44 may be further defined on one side by the central rib or extension member 47 as well as by the wall 173 which is generally aligned with the member 47 as well as the walls 70 and 72, and on its other side by the second side or wall 49 which extends from the first end 41 to the second end 42. The second channel 44 is further defined by the extension members 175 which also function to provide further evidence of tampering with the seal 210 as more fully described below. The seal 210 further includes a pair of reinforcing extension members 175 centrally located between the first and second chambers 43 and 44. A wall 173 extends between the first and second extension members 175, and another wall 174 extends upwardly from the first extension member 175 toward the upper end 41 of the insert 14 where the wall 74 joins the angled wall 64. Each of the first and second extension members 175 includes a round or circular base portion 176 partially extending above the base surface of the first and second chambers 43 and 44. Each of the first and second extension members 175 further include a generally centrally located, flattened side tamper evident extension member 177. The first and second extension members 175 are preferably integrally formed during the plastic injection molding process for forming the insert 14. Since the first and second extension members 175 are preferably formed from the same polymeric material, if the seal 210 is tampered with wherein the insert 14 is attempted to be removed or otherwise debased, the first and second extension members 175 will be blemished to evidence such tampering. Similarly, the supports 153 will also be blemished if such tampering is attempted on the seal 210.

As noted above, the first channel 43 may be further defined by the wall 60 which functions to lock the end 30 of leg 18 in the upper portion of the first channel 43 in a first or unsealed position, as best shown in FIG. 4, and a second or locked position as best shown in FIG. 6. The wall 60 extends upwardly from a wall 62. The wall 62 may be located approximately midway in the first channel 43 and may extend substantially horizontally from the central member 47 to the wall 60. An angled wall 64 extends from an upper portion of wall 60 at an angle toward the top end 41 of the insert 14. The wall 62 which further defines the first channel 43 may also function to be engaged by the end 30 of the leg 18 when the wire hasp 12 is in the locked position in the seal 210 as best shown in FIG. 6. The first channel 43 may be further defined by a wall 66 extending horizontally from the central rib 47 proximal the end 42 of the insert 14 and by an upper wall 67 extending horizontally from the central rib 47 to the opening 45 in the top and 41.

Figure 2:
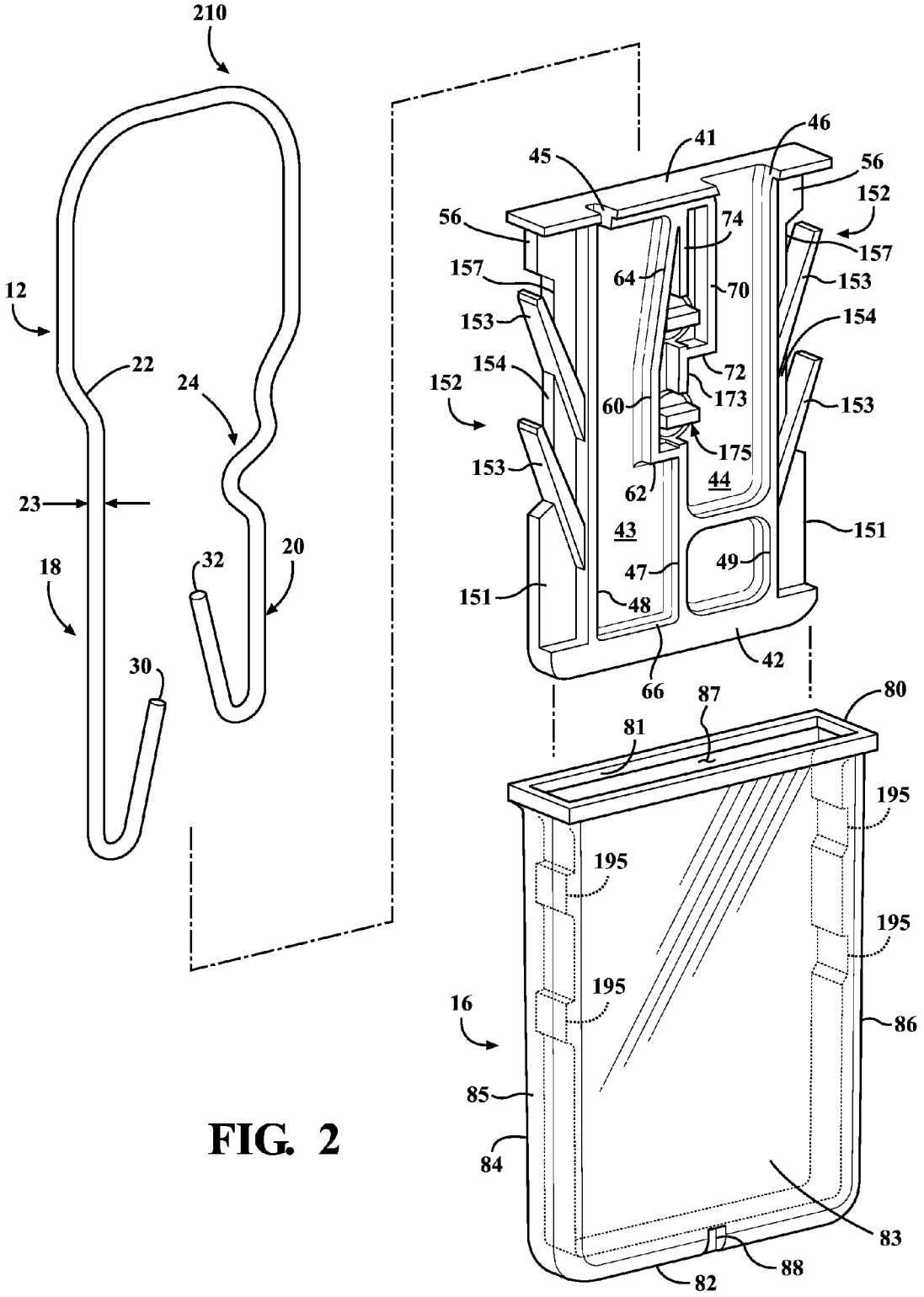
FIG. 2 is an exploded, perspective view of the tamper evident seal of the exemplary embodiment of FIG. 1.
Figure 3:
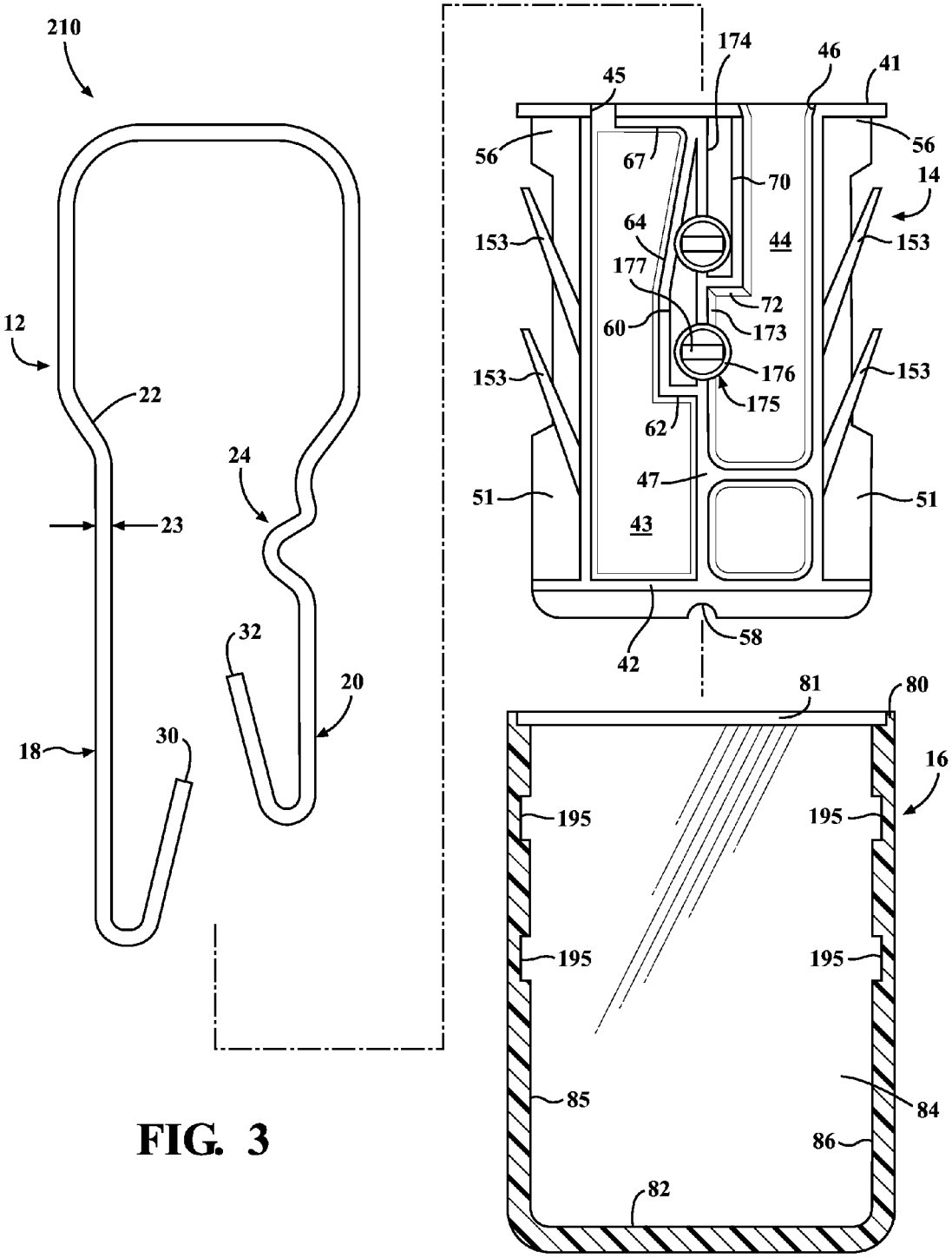
FIG. 3 is an exploded, partial, front plan view of the tamper evident seal of the exemplary embodiment of FIG. 1.

The angled wall 64, the opening 45 and the upper horizontal wall 67 function to secure the leg 18 in the first channel 43 in a first or unlocked position as best shown in FIG. 4. The width of the opening 45 in the top end 41 is designed and selected to be only slightly larger than the thickness 23 of the first leg 18 of the wire hasp 12. As best shown in FIG. 2, the opening 45 extends to a side of the top end 41. When the end 30 of the leg 18 of the wire hasp 12 may be located in the upper area of the first channel 43 proximate the angled wall 64, the end 30 of the leg 18 may abut the wall 67 as best shown in FIG. 4. Because the end 30 is reversibly bent to prevent removal of the leg 18 from the first channel 43 by the end 30 abutting the wall 67, once the insert 14 is secured in the body 16 and the opening 45 is closed by a side of the body 16, the leg 18 is secured within the first channel 43 in the first position and the wire hasp 12 is associated with the seal 210 and cannot be disassociated without being broken or severely deformed. Initially, the second leg 20 of the wire hasp 12 may have the bent end 32 located in the opening 46 during insertion of the insert 14 into the body 16. The wire hasp 12 may be sufficiently flexible such that the end 32 may be removed from the opening 46 in the top and 41 of the insert 14 so that the end 32 may pass through a hole 6 in a bolt 5 and through passages in ends of the ring 3 and may secure the objects together to function as a tamper evident seal 210.

The insert 14 may include a pair of coupling structures 152. Each coupling structure 152 may be located outwardly of the first and second side walls 48 and 49 of the insert 14. The coupling structure 150 may include an extension tab 151 located proximal the end wall 42 of the insert 14 and a pair of extension shoulders 56 extending outwardly of the first and second side walls 48 and 49 and also located proximal the end 41 of the insert 14. Each extension tab 151 extends outwardly from the outer surface of the first and second sidewalls 48 and 49, respectively. Each extension tab 151 may include a leading ramp portion for guiding the insert 14 during insertion into the body 16. The extension shoulders 56 and the extension tabs 151 function to secure and stabilize the insert 14 within the body 16 as best shown in FIGS. 4 through 6 and limit movement of the insert 14 relative to the body 16.

Each coupling structure 152 may further include a plurality of engagement members 153 extending from the first and second walls 48 and 49 of the insert 14 and a pair of middle extension members 154 located between the angled support members 153 located on one side of the insert 14. In one exemplary embodiment the angled support members 153 may be unitarily formed with the insert 14 by injection molding the plastic material of the insert 14. In the exemplary embodiment shown, the pair of shoulders 56 located at the top end 41 of the insert and extending outwardly from each of the first and second sidewalls 48 and 49, respectively, extend downwardly toward the second end 42 of the insert 14 and may also be unitarily formed with the engagement members 153. The extension shoulders 56 are ramped inwardly to a lower surface 157 of the extension shoulders 56 which may be substantially aligned with the outer surface of the middle extension member 154. The divorce surface 157 and the outer surface of the middle extension member 154 are designed to allow the ends of the angled support members 153 to be able to flex inwardly when the insert 14 is being located in the body 16.

The angled supports 153 may extend angularly outwardly and upwardly from the outside surface of each of the first and second walls 48 and 49, respectively, of the insert 14. Each end of each angled support 153 may be located distally from each of the first and second walls 48 and 49, respectively. Each angled support 153 preferably extends at an acute angle in a direction toward the top end 41 of the insert 14 such that when a force is applied to the wall 54, each support member 153 may flex, rotate or pivot toward the respective side wall from which it extends. The support members 152 may be preferably angled or ramped in a direction for engaging corresponding structure associated with the body 16 and preventing movement of the insert 14 in at least one direction with respect to the body 16.

The insert 14 may further include a passage 58 centrally located along the outer surface of the bottom end 42 and in communication with the first and second channels 43 and 44 of the insert 14. The passage 58 of the insert 14 is intended to communicate any fluid that becomes located in the first and second channels 43 and 44 of the insert 14 out of the insert 14 and through the body 16 to the external environment of the seal 210 via a passage or hole 88 in the body 16. In some instances, it is known that a fluid, including a corrosive fluid which may corrode and degrade the integrity of the material of the wire hasp 12, may be intentionally located in the first and second channels 43 and 44 of the insert 14.

The body 16 of the seal 210 may be a generally rectangularly shaped, five-sided box type structure sized and proportioned for receiving the insert 14 to be located therein. The body 16 may preferably include a first or top end 80 having an opening 81 through which the insert 14 may be inserted into the body 16, and a second or bottom end 82 which may be generally closed. The body 16 may further preferably include a front side 83, a backside 84 and first and second sides 85 and 86, respectively. The sides of the body 16 define a passage or chamber 87 in which the insert 14 is received and secured in place. Each of the first and second sides 85 and 86, respectively, of the body 16 may include a plurality of formed indentations 195 which may be designed to align and correspond with and receive the ends of the extension members 153 of each engagement member 152 of the insert 14 once the insert 14 is inserted or located in the passage 87 in the body 16. The recesses or indentations 195 may be preferably formed in the first and second sides 85 and 86, respectively, of the body 16 and may also be angled or ramped in one direction so that the extension members 153 of the engagement member 152 may move more easily in at least one direction with respect to the indented teeth 95 and may not move in an opposite direction. Accordingly, each indentation 195 preferably has an upper horizontal surface that is substantially perpendicular and a second lower surface that is angled with respect to the upper horizontal surface. The indentations 195 may be preferably formed proximal the top end 80 and spaced a distance from the opening 81 equivalent to the distance between the top and 41 and the extension members 153 of the insert 14.

Once the insert 14 is inserted in or located in the passage 87 in the body 16, as shown in FIG. 4 through FIG. 6, any attempt to remove the insert 14 from the body 16 will be resisted by the interaction of the extension members 153 with the indentations 195. Movement of the insert 14 when it is located in the passage 87 in the body 16 is limited in directions unaligned with the direction of insertion by the shoulders 56 and the extension tabs 151 as best shown in FIGS. 4 through 6.

Referring in particular to FIG. 4, the wire hasp 12 is shown in the first position in which the leg 18 is secure in the opening 45 and in the first channel 43 of the insert 14 in the body 16 but the second leg 20 has its reversely bent end 32 partially inserted in the channel 44 but the end 32 may be removed from the channel 44 since it does not engage the wall 72 defining the channel 44. Further, the leg 18 is limited from insertion further into the first channel 43 by the reversely bent portion 30 of the end of the leg 18 which helps to prevent the leg 18 from being mistakenly fully inserted in the first channel 43 such that the end 30 engages the wall 62. Similarly, the reversely bent end 32 of the leg 20 limits the movement of the wire hasp 12 into the channel 44 to prevent an unintended insertion of the leg 20 into the seal 10. With the end 32 of the leg 20 removed from the channel 44 the seal 210 may be applied to an object which is to be secured with the seal 210. It should be noted that it is possible for a user to remove the reversely bent and 32 of the leg 20 from the second channel 44 such that the seal 210 may be removed from the hole in the object 5.

Once the seal 210 has been passed through the hole in the object 5 and the user intends to fully engage the tamper evident seal 210, force is applied to the wire hasp 12 and the body 16 to cause the ends 30 and 32 of the wire hasp 12 to progress toward the end 42 of the insert 14 as best shown in FIG. 5. A sufficient force is required to overcome the inherent forces of the reversely bent ends 30 and 32 the wire hasp 12. The ends 30 and 32 of the legs 18 and 20, respectively, continue to travel through the first and second channels 43 and 44, respectively, toward the end 42 of the insert 14 until the ends 30 and 32 pass the bottom ends of the walls 60 and 70, respectively, to achieve the third or engaged position of the tamper evident seal 210 as best shown in FIG. 6. At this point, the ends 30 and 32 return to their natural positions under the inherent force of the material of the wire hasp 12 such that the end 30 of the leg 18 is aligned with and abuts the wall 62 and the end 32 of the leg 20 is aligned with and abuts the wall 72 and the wire hasp 12 can no longer be removed from the insert 14 without destroying some part of the pieces which it make up the seal 210 to evidence such tampering.

After having read the above regarding the tamper evident seal 10 of the exemplary embodiments as shown, it should be understood that it is possible to design the tamper evident seal 210 and to modify the first and second channels 43 and 44 of the insert 14 in any combination in an alternative embodiment of the tamper evident seal 210. Accordingly, it is possible for a seal 210 to include the design of the first channel 43 of the insert 14 for capturing both the leg 18 and the leg 20 of the wire hasp 12. Of course, in this embodiment the leg 20 of the wire hasp 12 will be modified to a design similar to the leg 18 of the wire hasp 12 and the method of assembling the wire hasp 12, the insert 14 in the body 16 will necessarily be modified such that the first and second legs 18 and 20, respectively, of the wire hasp 12 are both first located in the first and second channels 43 and 44, respectively, of the insert 14 and then the insert 14 will be located in the body 16 to secure the tamper evident seal 10. In this alternate exemplary embodiment, the second channel 44 is modified to have a design similar to the first channel 43 shown in FIGS. 4 through 6 such that the opening 46 at the top and 41 of the insert 14 will now have a width similar, if not identical, to the width of the opening 45 at the top end 41 of the first channel 43 of the insert 14 and which is only slightly bigger than the thickness 23 of the wire hasp 12. In this alternate exemplary embodiment, it is believed that it will be possible, if not preferred, for the leg 18 in the leg 20 of the wire hasp 12 to have the same length.

Any numerical values recited herein or in the figures are intended to include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc, are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Invention of a range in terms of at "'x' parts by weight of the resulting polymeric blend composition" also contemplates a teaching of ranges of same recited amount of "x" in percent by weight of the resulting polymeric blend composition."

Unless expressly stated, all ranges are intended to include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The use of the term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

The disclosure of "a" or "one" to describe an element, ingredient, component or step is not intended to foreclose additional elements, ingredients, components or steps. Plural elements, ingredients, components or steps can be provided by a single integrated element, ingredient, component or step. Alternatively, a single integrated element, ingredient, component or step might be divided into separate plural elements, ingredients, components or steps.

It is understood that the present description is intended to be illustrative and not restrictive. Many embodiments as well as many applications besides the examples provided will be apparent to those of skill in the art upon understanding the present disclosure. The scope of the claimed invention should, therefore, not be determined with limiting reference to the description, but should instead be determined with reference to the appended claims, along with the full scope of equivalents to which such claims are entitled. Any disclosure of an article or reference, including patent applications and publications, is incorporated by reference herein for all purposes. Any omission in the following claims of any aspect of subject matter disclosed herein is not a disclaimer of such subject matter.

We claim:

1. A security seal comprising:

a. a body having a front side and a backside spaced from the front side, the body having a chamber between the front side and the backside, and the body having a first end and a second end wherein the first end is open;

b. an insert located in the chamber, the insert having a first channel and a second channel, the insert further having a first end and a second end and wherein the first and second channels extend from the first end of the insert, and further wherein the first channel has an opening located proximal the first end of the insert, the opening of the first channel having a length;

c. a wire hasp having first and second legs, the first leg for being located and being locked in the first channel and the second leg for insertion and being locked in the second channel;

d. wherein the first leg of the wire hasp has a thickness that is slightly less than length of the opening of the first channel such that a liquid is significantly impeded from being able to pass into the chamber; and e. wherein the first channel and the second channel each have a base surface extending from the first end of the insert, and wherein a rib is located between the first channel and the second channel and extends from the base surfaces of the first channel and the second channel toward the front side of the body, and wherein an extension member including a round base portion extends from the base surface of the second channel, and wherein a tamper evident extension member extends from the round base portion toward the front side of the body, the tamper evident extension member having a flat face in parallel with the front side of the body.

2. The security seal of claim 1 wherein each of the first and second legs of the wire hasp has a reversely bent end portion for engaging a portion of the insert to prevent removal of the wire hasp from the body once the legs have been fully inserted therein.

3. The security seal of claim 2 wherein the first leg of the wire hasp is partially inserted in the first channel and the second leg of the wire hasp is insertable in the second channel of the insert.

4. The security seal of claim 1 further comprising a passage having a first end located proximal the second end of the chamber of the body and in communication with the chamber and a second end in communication with the atmosphere external of the tamper evident seal.

5. The security seal of claim 1 wherein the insert includes a first sidewall spaced from the rib with the first channel disposed between the first sidewall and the rib, and a second sidewall spaced from the rib with the second channel disposed between the second sidewall and the rib, and wherein the insert includes a plurality of angled engagement members extending from the first and second sidewalls for engaging the body and preventing removal of the insert from the body.

6. The security seal of claim 1 wherein the insert is disposed between the wire hasp and the body.

7. The security seal of claim 3 wherein the insert includes a second opening located proximal the first end of the insert and spaced from the opening for receiving the second leg of the wire, the insert including a wall extending from the second opening along the second channel, and the insert including another wall extending transverse to the wall for engaging the second leg of the wire.

8. The security seal of claim 5 wherein the body includes a first side extending from the front side to the backside, and a second side spaced from the first side and extending from the front side to the back side with the chamber extending from the first side to the second side, wherein the first side and the second side include indentations designed to receive the engagement members.

9. The security seal of claim 8 wherein the insert includes an extension tab extending from the first sidewall to the first side of the body, and an extension tab extending from the second sidewall to the second side of the body.

* * * * *